US005700208A

United States Patent [19]

Nelms

[11] Patent Number: 5,700,208

[45] Date of Patent: Dec. 23, 1997

[54] GOLF CLUB HEAD

[76] Inventor: Kevin Nelms, 3824 Diamond Loch W., Forth Worth, Tex. 76180

[21] Appl. No.: 696,175

[22] Filed: Aug. 13, 1996

[51] Int. Cl.[6] ..... A63B 53/04

[52] U.S. Cl. ..... 473/324; 473/327

[58] Field of Search ..... 473/324, 327, 473/228, 223, 251, 378, 383, 384

[56] References Cited

U.S. PATENT DOCUMENTS

| | | | |
|---|---|---|---|
| 3,997,170 | 12/1976 | Goldberg . | |
| 4,065,133 | 12/1977 | Gordes . | |
| 4,560,168 | 12/1985 | Aoyama . | |
| 4,754,974 | 7/1988 | Kobayashi . | |
| 4,830,378 | 5/1989 | Aoyama | 473/384 |
| 4,886,277 | 12/1989 | Mackey | 473/383 |
| 4,949,976 | 8/1990 | Gobush | 473/384 |

FOREIGN PATENT DOCUMENTS

| | | | |
|---|---|---|---|
| 475525 | 4/1974 | Australia . | |
| 0000538 | 1/1977 | Japan | 273/167 E |
| 406007484 | 1/1994 | Japan | 273/167 E |
| 377354 | 8/1932 | United Kingdom . | |
| 2012597 | 8/1979 | United Kingdom | 273/167 E |

OTHER PUBLICATIONS

Wilson Sporting Goods, Co. v. David Goeffrey & Assoc. /14 USPQ 2d 1942 May 23, 1990.

Article on Internet by David Tuttleman, Jan. 1996 Address: http://duakin.prin...n.1.htal$frequency.

"Golf Digest", Magazine, advertisement for *Riley Powershell*, Sep. 1982.

*Primary Examiner*—Sebastiano Passaniti

*Attorney, Agent, or Firm*—Griggs, Robinson, Post & Henderson LLP

[57] ABSTRACT

A golf club head includes a face portion and a major body portion to which the face portion is connected. The surface area of the major portion has a plurality of space indentations, such as dimples, over the entire surface area.

17 Claims, 3 Drawing Sheets

GOLF CLUB HEAD

BACKGROUND OF THE INVENTION

1. Field of the Invention

This invention relates to a golf club head, and more particularly, to a golf club head in which the aerodynamic characteristics of its surface are improved.

There has been a substantial amount of research development and investment in obtaining a golf system that includes a golf club and a ball that will enable the golfer to play the game with maximum consistency and accuracy. For example, in U.S. Pat. No. 4,560,168 there is disclosed a golf ball with evenly and uniformly distributed dimples so that 6 great circle pads on the surface of the golf ball did not intersect any dimples. The patent describes in great detail the importance of dimples to the aerodynamic characteristics of a golf ball and the relationship thereto to the dimple pattern that was incorporated therein.

Although dimples on golf balls are typically circular in shape, a patent issued in the United Kingdom, Patent Number 377,354, disclosed a triangular shaped pattern of dimples on the surface of a golf ball.

Similarly, a substantial amount of research has also been performed on the technology of golf dubs. U.S. Pat. No. 4,754,974 discloses a head for a golf club comprising a body having a face portion for hitting a golf ball and a back portion. A surface structure produces a turbulent boundary layer in the air on the outer surface of the head body. The produced turbulence is over the outer surface and substantially throughout a region from the periphery of the face portion of the head body to the back portion of the head body. The surface structure discloses a plurality of fine grooves and alternatively, a plurality of fine fibers erected on the outer surface of the head portion.

There have been other attempts to increase the accuracy of the golfing system by modification of the head portions of a golf club such as that disclosed in U.S. Pat. No. 4,065,133 which discloses a number of space grooves formed in the head that are substantially normal to the ball striking surface of the head.

In a similar fashion, U.S. Pat. No. 3,997,170 also disclosed a number of space grooves formed in the head that are substantially normal to the striking surface of the head but are closed at the end opposite from the ball striking surface.

The physics related to the design of a golf club is very complex. To be an effective club, there has to be a balancing of the characteristics of the shaft such as vibration, flexibility and rotational torque dynamics that will insure that the maximum amount of power or energy transferred from the head, in particular, the ball striking surface or face of the golf club to a ball. The physics of a golf club is described in an article published on the Internet by Dave Tuttelman in January 1996. The Interact address is http://duakin.prin...n.1.htal$frequency.

During the swing of the golf club by a golfer, it is imperative that the maximum head speed be achieved and the rotational torque transferred from the golf club head to the shall be minimized. One way of improving the head speed and reducing the rotational torque is to reduce the drag produced by the golf club head during the swing of the golf club.

SUMMARY OF THE INVENTION

A golf club head includes a face portion and a major body portion to which the face portion is connected. The surface area of the body portion has a plurality space indentations, such as dimples, over the entire surface area.

The dimples, on the surface area of the major body portion, are arranged around an axis that has a first coordinate that is normal to the face portion and a second coordinate that is in parallel alignment with the face portion. The pluralities of dimples are aligned in a pattern that is in parallel alignment with the face portion and the first and second coordinates.

The golf club head, of course, has a side, a top and a bottom as part of the surface area. There is a transition between the top and the sides and the bottom and the sides. Each transition creates a boundary. In one embodiment of the invention the pluralities of indentations are arranged in a pattern such that no member of the plurality of indentation is coincidental with any of the boundaries. Additionally, it is optimum that the indentations are spaced over the surface area of the major body portion such that there will be no area that is absent of indentations.

Applicant has developed a unique arrangement of dimples to create a turbulent boundary layer around all surfaces other than the face portion of the golf club head. This turbulent boundary is a cushion of air which will allow air to flow around the club head with a minimum of drag. The reduced club head drag also reduces the rotational torque. The reduction in drag will allow the club head to achieve an improved velocity. The reduction in rotational torque will insure a proper contact between the golf ball and the golf club head at the appropriate angle.

DESCRIPTION OF THE EMBODIMENT

Figure 1:
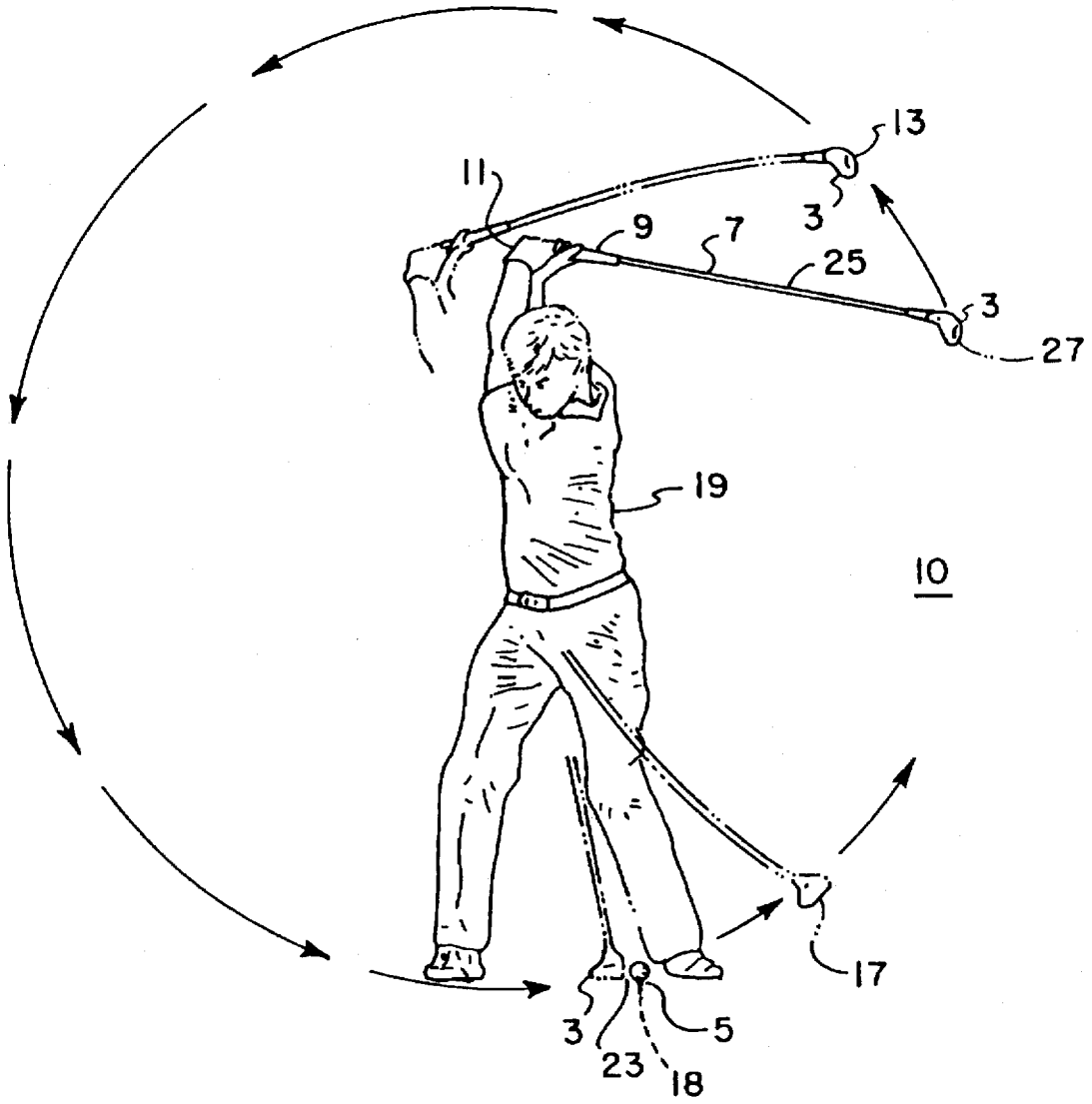
FIG. 1 is an illustration of the operation of a golfing system.

In FIG. 1, to which reference should now be made, there is shown a golfing system 10 according to the invention. The system includes a club 25, a tee 5 and a ball 23. The golf club 25 includes a head 3, a shaft 7 and a grip 9. In normal operation, a golfer 19 begins his swing at position 27. As he begins his swing, the hands 11 move ahead of the head 3 such as illustrated at position 13, (an exaggerated view of the effect of the swing of the golfer). This is primarily caused by the inertia when the golfer initiates his swing and the fact that the shaft 7 is designed to flex. The flexation is actually a form of stored energy that is ideally dissipated when the club head 3 comes in contact with the ball 5 at position 18. At position 18 the spring constant and flexibility of the shaft forces the golf club head 3 into a straight line with the shaft 7 and the energy previously stored by the inertia is unloaded onto the ball 23. At position 17 the head moves ahead of the golfer's hands 11.

For the golfing system 10 to operate in a consistent accurate manner, the wind drag experienced by the golf club head 3 must be minimized. This is necessary so that the golf club head strikes the ball 23 in proper alignment. Consequently, the wind drag on the club as well as the rotational torque to the shaft provided by the drag on the outer edge of the golf club head 3 must be reduced.

Figure 2:
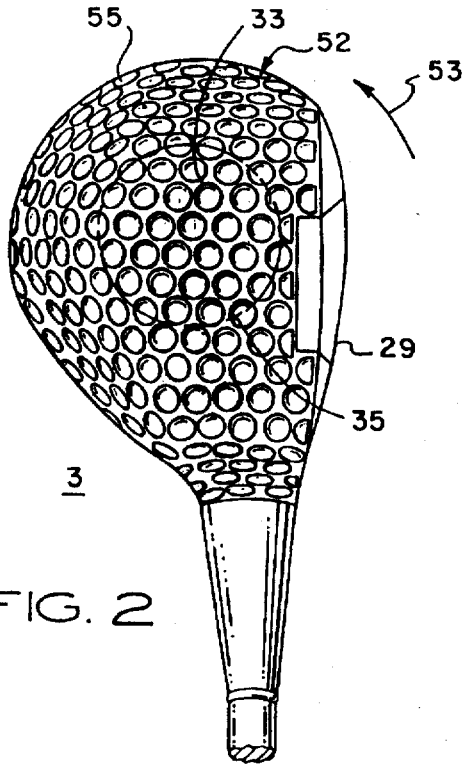
FIG. 2 is a top view of a golf club head according to the invention.
Figure 3:
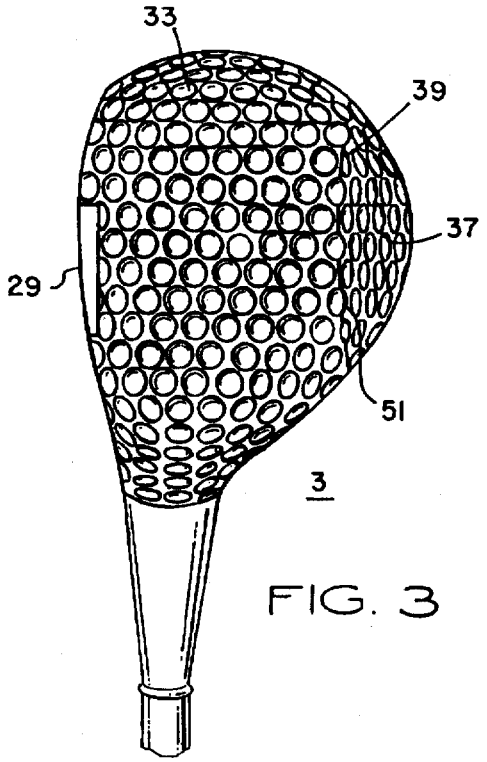
FIG. 3 is the bottom of the golf club head of FIG. 2.

In FIGS. 2 and 3, to which reference should now be made, there is shown the golf club head 3 having a plurality of dimples 33 on its outer surface. FIG. 3 is the bottom of the club head of FIG. 2. The head has a face 29 which is the portion of the club head that comes in contact with the golf ball 23. The dimples 33 are aligned to create turbulence around the periphery of the club head 3 during the swing. Consequently, the side portion 37 also has a dimple pattern arrangement. The side dimple pattern arrangement aids in reducing the torque, indicated by arrow 53, that the club head 3 is subject to during the swing. As a side note, in the embodiment of FIGS. 2 and 3, the dimple pattern coincides with the boundary 39 at 51 and the boundary 55 at 52. Therefore, there is only a partial dimple illustrated. This can reduce the effectiveness of the dimple pattern to the drag to which the club head 3 is subjected and this problem is addressed in the embodiment of FIGS. 7, 8 and 9.

Figure 4:
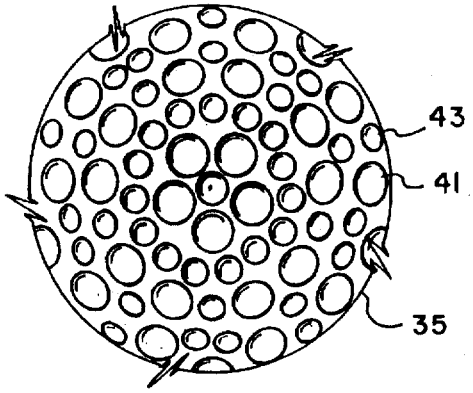
FIGS. 4, 5, and 6 are optional arrangements of indentation patterns that may be included in the golf club head according to the invention.
Figure 5:
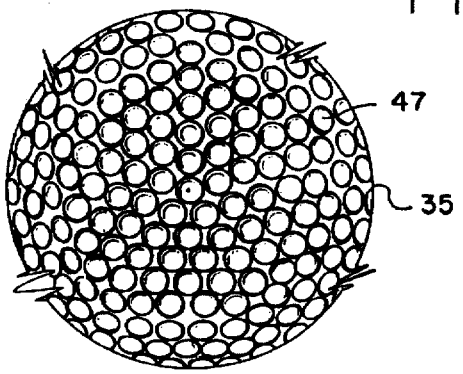

There are many indentation patterns that can be utilized. Section 35 is reproduced in FIGS. 4, 5 and 6 which illustrate alternative patterns for coveting the surface area of the golf club head 3. In FIG. 4 there is an alternate pattern that has large dimples illustrated at 43 and small dimples illustrated at 35. The rules for selecting an indentation pattern are:

The indentations must be evenly and uniformly distributed over the surface areas of the golf club head;

The indentation pattern, if possible and ideally, should be made of smaller patterns of indentations such as that shown in FIG. 5;

The indentation pattern shown is localized around an axis having a center point at the center of mass on each surface; and, Ideally, there should be no bald patches or indentations free areas and no partial indentation on any surface.

Figure 6:
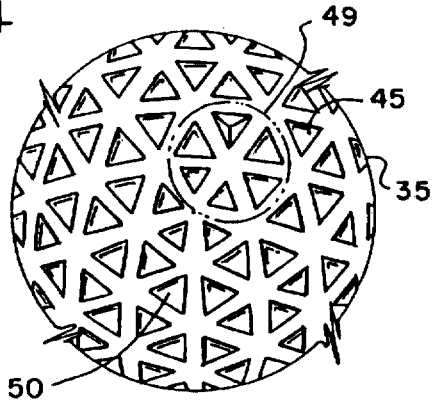

In FIG. 5 there is a very dense pattern of dimples 47. FIG. 6 there is a plurality of patterns of triangles 49. Each pattern includes 6 triangles 45. Each triangle 45 has an indentation that resembles a pyramid.

The depth of each indentation is based on its diameter. For example, when the indentation resembles a circle then the depth is approximately between 3% and 8% of the diameter.

In the case of the triangle 45, which has 3 equal sizes, the depth at the apex is 6% to 16% of a straight line dram from the center of the triangle to the center of any angle.

Figure 7:
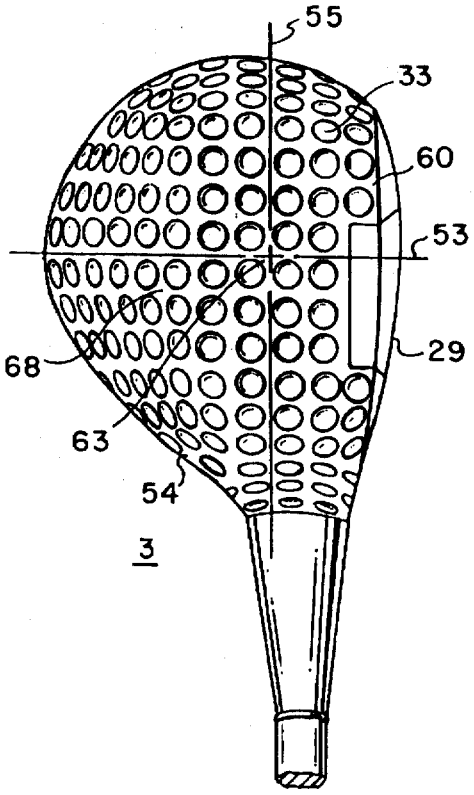
FIGS. 7, 8, and 9 are embodiments of the golf club head according to the invention with FIG. 7 being a top view, FIG. 8 being a bottom view and FIG. 9 being a side view.
Figure 8:
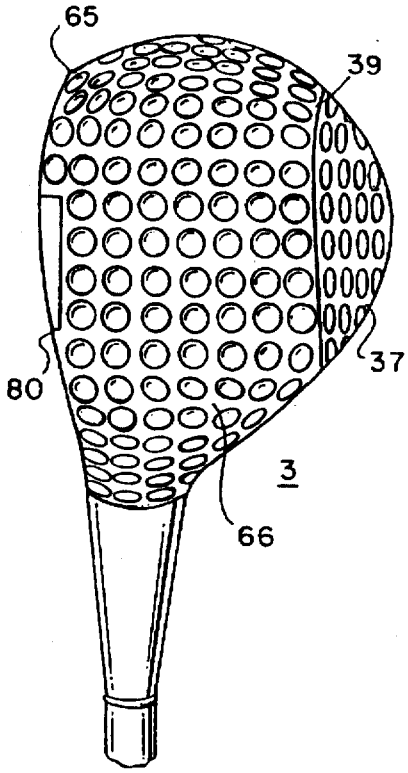
Figure 9:
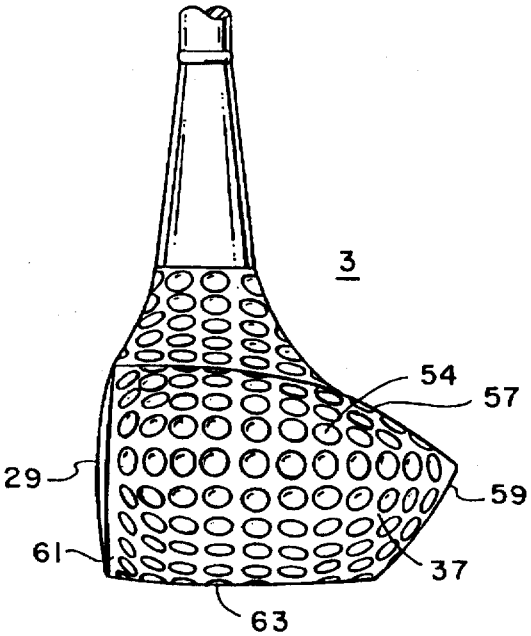

FIGS. 7, 8 and 9 illustrate an embodiment of the invention in which the golf club head includes a top 68 and a face 29 joined at a boundary 60 and to a side 37 at boundary 54. The side 37 is a curved section that is joined to the face at boundary 61 on one end and at boundary 65 on the other end. A bottom 66 is joined to the face at boundary 80 and to the side at boundary 39.

In FIG. 7 there is an axis established directly above the center of mass located at a center point 63. There is one coordinate 53 that is normal to the face of the golf club head 3 and a second coordinate 55 that is parallel to the golf club face 29. The plurality of dimples 33 are arranged in a pattern such that no dimple intersects or coincides with any axises 53 and 55 or any boundaries 60, 54, 61, 65, 80, & 39. The pattern of dimples is arranged such that there are no bald spots on any surfaces of the golf club head 3. The center point, a projection of the center of mass to a surface, should be located on each surface and axis both normal and parallel to the face portion 29 be established and the indentations aligned as described above.

While in the forgoing specification, a detailed description of the specific embodiment of the invention has been set forth for the purposes illustrated, it will be understood that many of the details herein given may be varied considerably of those skilled in the art without departing from the spirit and scope of the invention.

I claim:

1. A golf club head comprising:

a face portion;

a body portion to which the face portion is connected and said body portion including a surface portion other than the face portion having a plurality of spaced indentations, wherein the golf club head has an axis centered around a center of mass, the axis having a first coordinate that is normal to the face portion and a second coordinate that is in parallel alignment with the face portion, the plurality of spaced indentations being aligned in a pattern that is in parallel alignment with the face portion, the first coordinate and the second coordinate and no member of the plurality or spaced indentations coincides with the first and second coordinate.

2. The golf club head according to claim 1 wherein each indentation has a diameter and a depth and wherein the depth has a range of 3% to 8% of the diameter of the indentation.

3. The golf club head according to claim 1 wherein the golf club head comprises:

a top portion connected to the face portion on a top end at a first boundary;

a bottom portion connected to the face portion on a bottom end at a second boundary;

a side portion being connected to the face portion on a first side end at a third boundary and on a second side end at a fourth boundary and also being connected to the bottom portion at a fifth boundary and to the top portion at a sixth boundary; and wherein no single member of the plurality of indentations is coincidental with the first, second, third, fourth, fifth and sixth boundaries.

4. The golf club head according to claim 3 wherein the pattern further comprises an arrangement of the indentations such that there are no bald spots on the top, bottom or side portions.

5. The golf club head according to claim 3 wherein the indentations are dimples and the pattern includes dimples having varying sizes in diameter.

6. The golf club head according to claim 1 wherein each indentation is shaped as a dimple.

7. The golf club head according to claim 1 wherein each indentation is shaped as a triangle.

8. The golf club head according to claim 7 wherein each triangle shaped indentation has a depth that falls within a range of between 6% and 16% of an axis of the triangle.

9. The golf club head according to claim 1 further including a shaft connected to golf club head and on the opposite end of the shaft away from the golf club head is a grip.

10. A golf club head having a shaft connected on one end and a grip connected on the end of the shaft opposite the golf club head, the golf club head comprising:

a face portion;

a body portion to which the face portion is connected and said body portion including a surface portion other than the face portion having a plurality of spaced indentations wherein the golf club head has an axis centered around a center of mass, the axis having a first coordinate that is normal to the face portion and a second coordinate that is in parallel alignment with the face portion, the plurality of spaced indentations being aligned in a pattern that is in parallel alignment with the face portion, the first coordinate and the second coordinate and no member of the plurality of spaced indentations coincides with the first and second coordinate.

11. The golf club head according to claim 10 wherein each indentation has a diameter and a depth and wherein the depth has a range of 3% to 8% of the diameter of the indentation.

12. The golf club head according to claim 10 wherein the golf club head comprises:

a top portion connected to the face portion on a top end at a first boundary;

a bottom portion connected to the face portion on a bottom end at a second boundary;

a side portion being connected to the face portion on a first side end at a third boundary and on a second side end at a fourth boundary and also being connected to the bottom portion at a fifth boundary and to the top portion at a sixth boundary; and wherein no single member of the plurality of indentations is coincidental with the first, second, third, fourth, fifth and sixth boundaries.

13. The golf club head according to claim 12 wherein the pattern further comprises an arrangement of the indentations such that there are no bald spots on the top, bottom or side portions.

14. The golf club head according to claim 12 wherein the indentations are dimples and the pattern includes dimples having varying sizes in diameter.

15. The golf club head according to claim 10 wherein each indentation is shaped as a dimple.

16. The golf club head according to claim 10 wherein each indentation is shaped as a triangle.

17. The golf club head according to claim 16 wherein each triangle shaped indentation has a depth that falls within a range of between 6% and 16% of an axis of the triangle.

* * * * *